US005421520A

United States Patent [19]

Simonette et al.

[11] Patent Number: 5,421,520

[45] Date of Patent: Jun. 6, 1995

[54] PORTABLE PRESSURE WASHER

[75] Inventors: Dallas W. Simonette, Andover; Jon Bruggeman, Blaine, both of Minn.

[73] Assignee: Diversified Dynamics Corporation, Blaine, Minn.

[21] Appl. No.: 116,129

[22] Filed: Sep. 2, 1993

[51] Int. Cl.[6] ..... B05B 9/01

[52] U.S. Cl. ..... 239/525; 239/332; 414/234

[58] Field of Search ..... 239/152–154, 239/332, 525; 417/234, 364, 310

[56] References Cited

U.S. PATENT DOCUMENTS

| | | | |
|---|---|---|---|
| 3,826,426 | 7/1974 | Bonvicini . | |
| 3,904,116 | 9/1975 | Jones et al. . | |
| 4,404,706 | 9/1983 | Loyd | 417/234 |
| 4,461,055 | 7/1984 | Zerrer et al. | 417/234 |
| 4,792,096 | 12/1988 | Gregory | 239/525 |
| 4,810,169 | 3/1989 | Kränzle | 239/152 |
| 4,926,904 | 5/1990 | Polk et al. | 417/234 |
| 5,035,586 | 7/1991 | Sadler et al. | 417/364 |
| 5,169,068 | 12/1992 | Bertolini | 239/154 |

FOREIGN PATENT DOCUMENTS

| | | | |
|---|---|---|---|
| 837369 | 6/1960 | United Kingdom . | |
| 90/02879 | 3/1990 | WIPO | 417/234 |

*Primary Examiner*—Karen B. Merritt

*Attorney, Agent, or Firm*—Merchant, Gould, Smith, Edell, Welter & Schmidt

[57] ABSTRACT

A self-contained, completely portable pressure washer is disclosed which requires only connection to a conventional garden hose for operation. The portable pressure washer is driven by a two-cycle, internal combustion engine that is of relatively small size and weight. A positive displacement pump of the vane type is connected to the engine through a centrifugal clutch that causes operation of the pump only after a predetermined engine speed greater than idling speed has been reached. A garden hose is connected to the pump inlet and a substantially rigid spray wand having a spray head is mounted directly to the pump outlet. A primary handle on the engine housing and a secondary handle on the spray wand enable the user to carry and manipulate the portable pressure washer during all operative spray functions.

11 Claims, 2 Drawing Sheets

PORTABLE PRESSURE WASHER

BACKGROUND OF THE INVENTION

The invention broadly relates to high pressure washing devices and is specifically directed to a portable pressure washer the entirety of which is hand-held (i.e., the entire device is carried and manipulated by the user during pressure washing functions).

High pressure washing devices exist in a wide variety of forms and perform many functions in industrial, commercial and home applications. These devices typically include an electric motor or gasoline internal combustion engine that drives a pump to which a high pressure spray wand is connected. Larger high pressure washers may be stationary and include a long hose that extends from a large electric motor and pump unit to the area of use, including a spray wand having a handle or trigger for controlling the spray. An example of a stationary high pressure washer is the type found in car washes.

More portable devices are available for home use, and although characterized as portable this generally means that the power/pump unit can be carried or wheeled from one place to another. A conventional garden hose is connected to the pump inlet, and a separate hose and spray wand is connected to the pump output. During use, the power/pump unit remains on the ground or other supporting surface, and flexibility of use results from the length of the output hose lending from the power/pump unit. The hose typically includes a spray wand that having a handle or trigger for turning the spray on or off. Such devices perform the high pressure spray function quite well, but are disadvantageous from the standpoint of size, weight and true portability.

The inventive portable pressure washer is the result of an endeavor to create a device that is fully portable in the sense of being hand-held. The inventive device is both small and light weight, and the entire unit is carried and manipulated by the user in performing the high pressure spray function.

In the preferred embodiment, the inventive portable pressure washer operates with a smaller, two-cycle internal combustion engine such as those used in chain saws, blowers and flexible line trimmers. The engine is carried in a housing having a primary handle which the user holds to both carry and to manipulate the device.

The pumping device is of the positive displacement type (e.g., vane-type), and the pump used in the preferred embodiment is specifically intended for use with electric motors rather than internal combustion engines and for entirely different applications. It has been adapted for the inventive pressure washer and is particularly advantageous for several reasons. First, it is relatively small and of relatively low weight, and hence particularly useful from the standpoint of full portability. Second, it operates in line with the internal combustion engine, thus lending itself to the concept of hand portability. Third, since it operates on a rotating vane principle, there is no pulsation in its output. Last, the vanes themselves are formed from a long wearing material such as carbon graphite, which means that the pump life is significant, and statistically longer than the engine life.

Matching this type of pump to a two-cycle engine is itself significant. As indicated above, the type of vane pump employed in the inventive device is normally intended for use with electric motors, which typically operate at a constant speed that is much lower than the operating speed of a two-cycle internal combustion engine. In the preferred embodiment, the vane pump is operated at approximately four times its normal speed. While this increased speed may lessen the anticipated pump life to a degree, the pump life is still much longer than the anticipated engine life.

The vane pump/engine match is also significant because conventional electric motors operate in a direction opposite that of internal combustion engines. While this would normally present a problem insofar that pump operation is concerned, vane pumps may be operated in either direction. The vane pump chosen for the inventive device can be easily modified for reverse operation by minor porting changes.

The engine and pump are coupled through a centrifugal clutch, which is also highly unusual for high pressure washing devices. Inclusion of the centrifugal clutch offers several distinct advantages, one of which is that coupling between the engine and pump is permitted only after the engine has reached a predetermined operational speed greater than idling speed. Second, and conversely, the pump only runs when the user wishes to generate a pressurized spray; i.e., by bringing the engine up to operating speed. Third, the engine and pump are uncoupled by the centrifugal clutch when the engine is at rest, enabling the engine ,to be started without the load of the pump. This not only makes the engine easier to start, but also requires less work on the part of the user during the start operation.

The spray wand of the inventive portable pressure washer is connected directly to the output of the pump. In the preferred embodiment, the wand is substantially rigid and is threaded directly into the output port, including a secondary handle enabling the user to carry and manipulate the device with both hands.

To operate the inventive portable pressure washer, all that is necessary is to connect a conventional hose to the pump inlet, open the hose faucet and to start the engine. The user thereafter raises or lowers engine speed as desired through the engine trigger, which starts and stops the pump through the intervention of the centrifugal clutch. With the pump running the user simply manipulates the device by pointing the wand and pressured spray head toward the object to be washed and brings the engine up to operating speed. As soon as the engine trigger is released, the engine falls to idling speed, the pump stops and the pressure spray ceases.

DESCRIPTION OF THE PREFERRED EMBODIMENTS

Figure 1:
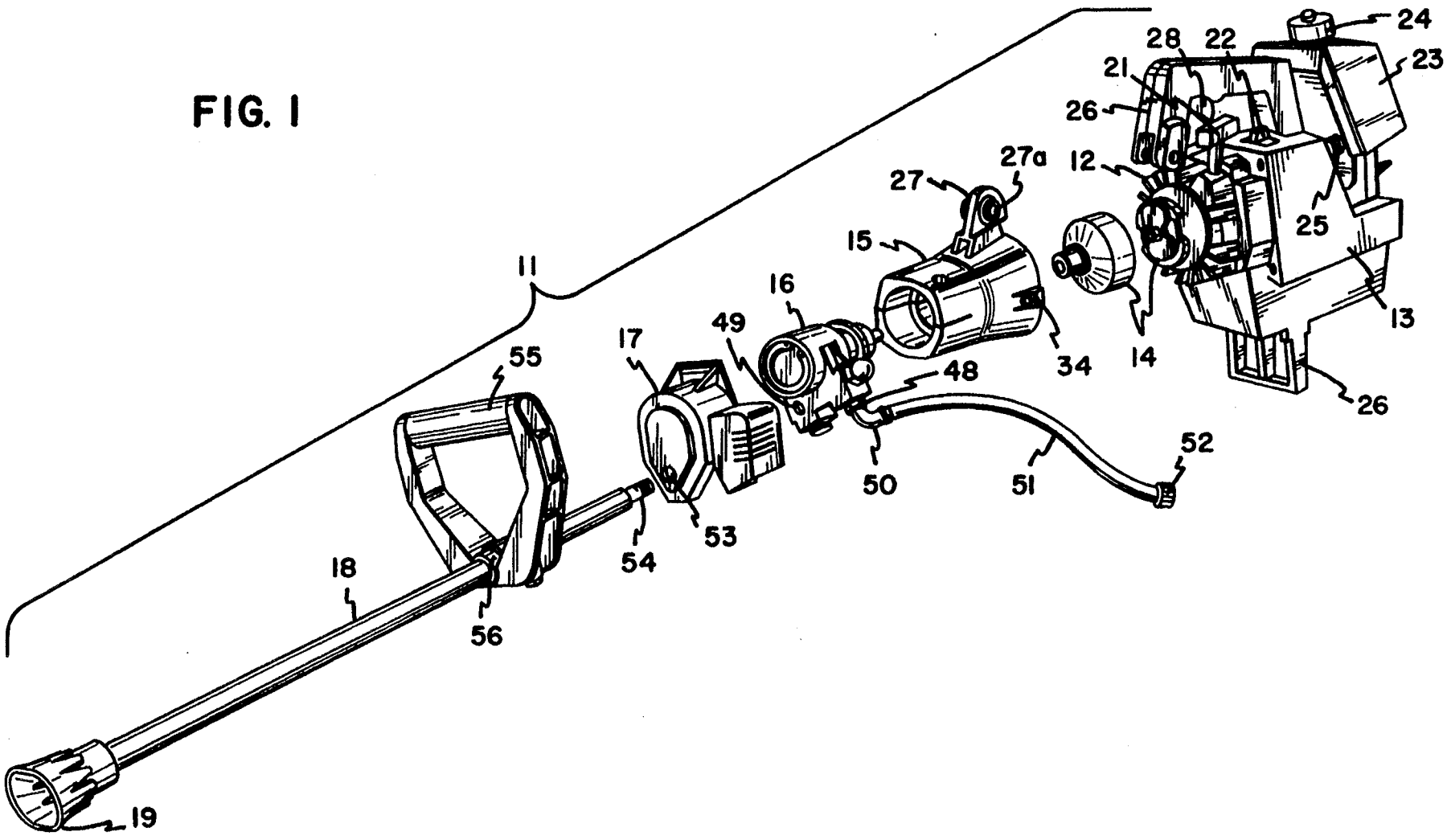
FIG. 1 is an exploded perspective view of a portable pressure washing device embodying the invention.

With initial reference to FIG. 1, a portable pressure washer embodying the invention is represented generally by the numeral 11. Portable pressure washer 11 comprises a two-cycle internal combustion engine 12 contained in a housing 13. A centrifugal clutch 14 is mounted to the output shaft of the engine, as described in more detail below. A clutch cowl or shroud 15 is bolted to the engine housing 13 in surrounding relation to the centrifugal clutch 14.

A rotary pump 16 is operably connected to the centrifugal clutch, and a cowl or shroud 17 bolts to the cowl 15 in protective surrounding relation to the pump 16. A spray wand 18 is connected to the output of pump 16 and includes a spray head 19 for dispersing a spray of a predetermined pattern.

More specifically, engine 12 is preferably of the two-cycle internal combustion type and may range in size depending on the application. The most important factor in this regard is that the engine be large enough to effectively drive the pump but small enough to carry. The size of engine 12 in the preferred embodiment is 32 cc (displacement), which is approximately 1 horsepower. Engine 12 is manually started through a retractable coil start 21 and includes an on-off switch 22.

A conventional fuel tank 23 having a removable cap 24 is mounted to the housing 13 through a pair of coil springs 25, only one of which is shown in FIG. 11. The coil springs 25 isolate the fuel tank 23 and handle 26 from vibration of the engine 12.

Housing 13 further comprises a downwardly projecting leg 26 which supports the pressure washer 11 when it is placed on the ground or another supporting surface. The device may be tilted rearwardly so that the spray head 19 does not come into contact with the ground.

A D-shaped handle has one end mounted to the front side of fuel tank 23. In the preferred embodiment, the fuel tank 23 and handle 26 are integrally molded from plastic. The opposite end of handle 26 is loosely bolted to an upwardly projecting ear 27 on clutch cowl 15. Preferably, this loose bolting is accomplished through a rubber grommet **27*a* which, with the coil springs 25, isolates the handle 26 and fuel tank 23** from engine vibration.

A trigger 28 is operably mounted on handle 26 to operate the engine carburetor (not shown) in a conventional manner, permitting the user to vary the speed of engine 12 between idling and maximum speeds.

Figure 2:
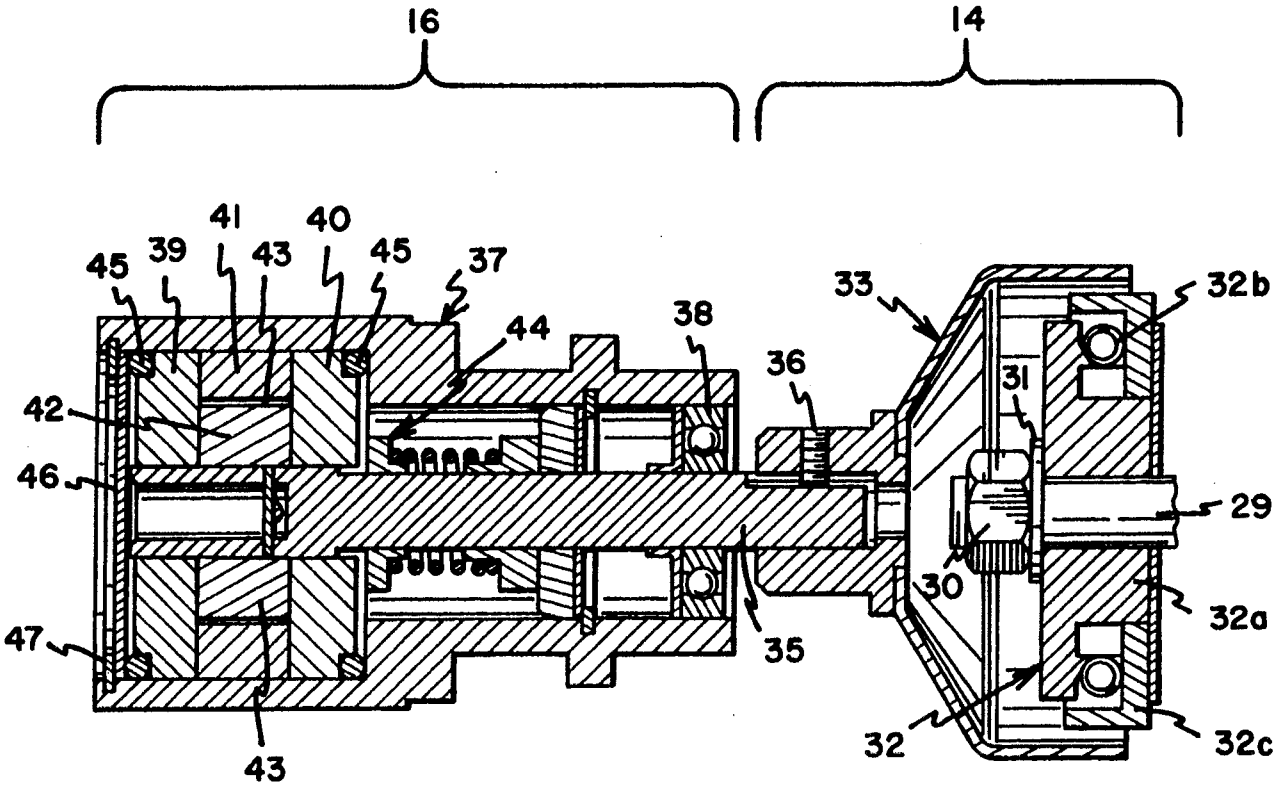
FIG. 2 is a sectional view of the centrifugal clutch and vane pump of the inventive portable pressure washer.

With reference to FIG. 2, engine 12 has an output shaft 29, and centrifugal clutch 14 is mounted to the shaft 29 through the use of a nut 30 and washer 31. Centrifugal clutch 14 includes a drive portion 32 (the portion mounted to shaft 29) and a driven portion 33 which takes the form of a bell housing. Drive portion 32 includes a hub **32*a*, a circumferential coil spring 32*b* and radially expandable centrifugal weights 32*c*. At a predetermined rotational speed of engine 12 and shaft 29, the weights 32*c* expand radially outward by centrifugal force against the bias of spring 32*b* and engage the bell housing 33 in clutching relation, causing the bell housing 33** to rotate.

With reference to FIG. 1, clutch cowl 15 includes a pair laterally projecting ears 34 (only one of which is shown), and the cowl 15 is bolted to the engine housing 13 with screws (not shown).

With continued reference to FIG. 2, rotary pump 16 is of the positive displacement type. The preferred embodiment employs a vane type pump manufactured by Procon Products, Division of Roehlen Industries of Murfreesburo, Tenn.

Pump 16 includes a shaft 35 to which the bell housing 33 is mounted through a set screw 36. Pump 16 includes a housing 37, and shaft 35 is rotatably carried by a bearing 38 at one end and by spaced front and rear bearings 39, 40 at the other. Disposed between the bearings 39, 40 is a stationary annular liner 41 defining a cylindrical pump chamber.

A rotor 42 is rotatably mounted on the shaft 35 and disposed in the chamber between the front and rear bearings 39, 40. Rotor 43 carries four equiangularly spaced vanes 43, each of which slidably engages the inner surface of annular liner 41.

A spring loaded seal assembly 44 compresses the front and rear bearings 39, 40 relative to the annular liner 41, and O rings 45 also assist in sealing the unit. An end plate 46 is held in place by a split ring keeper 47 and retains the assembly.

The opposed inner faces of the front and rear bearings 39, 40 are contoured (not shown) to define porting channels respectively connected to a pump inlet 48 and outlet 49 (see FIG. 1), each of which compromises an internally threaded bore. An elbow 50 is threaded into the inlet 48, and a flexible hose 51 is secured to the elbow 50. A conventional coupling 52 on hose 51is adapted for connection with a conventional garden hose (not shown).

The vane pump used in pressure washer 11 is normally intended for direct coupling to an electric motor that rotates in a first direction at an operating speed of 1,725 rpms. Internal combustion engine 12 of the preferred embodiment has an operating speed of approximately 6,200 rpms and rotates in a direction opposite that of an electric motor. Nevertheless, pump 16 may be operated in a reverse direction because it is of the vane type through minor porting modifications, and the increased rotational speed has been found not to have an adverse effect on pump life relative to the anticipated life of engine 12. At 6,200 rpms, pump 16 produces approximately 2.6 gallons per minute at 220 psi. Should pressure in the system increase to 300 psi, pump 16 operates in an internal bypass mode.

Pump cowl 17 is screwed to the clutch cowl 15 through the use of a plurality of screws not shown. It includes an aperture 53 that registers with the pump outlet 49 when the components are assembled.

Spray wand 18 compromises a long, substantially rigid tube that is externally threaded at its inner end 54 to project through the aperture 53 and into threaded engagement with pump outlet 49. A secondary handle 55 is mounted on wand 18 for use with primary handle 26. A rubber bushing 56 is disposed between handle 55 and wand 18 to reduce vibration to the users hand. Spray head 19 is conventional and threadably mounted to wand 18 to permit interchangeability with other spray heads to obtain a desired spray or jet pattern.

The overall weight of portable pressure washer 11 in the preferred embodiment is approximately 12.5 pounds. A two-point shoulder strap (not shown) may be connected to pressure washer 11 to assist carrying it during operation.

In operation, a garden hose connected to a faucet (neither of which is shown) is connected to the coupler 52, and the faucet is then opened. On-off switch 22 is then moved to the "on" position and engine 12 is started with the retractable coil start 21. In the preferred embodiment, centrifugal clutch 14 engages at approximately 4,000 rpms, which is higher than the idling speed of the engine 12. As such, the drive and driven portions 32, 33 of clutch 14 are disengaged when engine 12 is started, thus avoiding the additional load of pump 16. Engine speed may be increased and decreased with trigger 28, which is operatively connected to the engine carburetor, and when the engine speed exceeds approximately 4,000 rpms drive portion 32 clutchably engages driven portion 33 resulting in operation of pump 16. As long as this engine speed is maintained, water received from inlet 48 will be delivered by pump 16 to the spray head 19 under pressure. As soon as trigger 28 is released and engine speed drops below 4,000 rpms, clutch 14 disengages and pump 16 ceases to rotate, interrupting the flow of pressurized water at the spray head 19. Operation of pressure washer 11 may continue on demand so long as engine 12 is running and pump 16 receives a supply of water through its inlet 48. When spray operations are completed, engine 12 is turned off with switch 22, the hose faucet turned off and hose removed from the coupling 52. Pump 16 is self draining through hose 51 and coupling 52 if they are maintained at a lower position than pump 16.

Based on the foregoing, it will be appreciated that portable pressure washer 11 is relatively light weight and thus easy to use, and coupling the engine and pump through a centrifugal clutch provides a number of advantageous functions including simplified engine starting, operation of the pump on demand, and interrupted operation of the pump when the engine is idling.

What is claimed is:

1. A portable pressure washer comprising:

engine means having an output shaft and being capable of operation over a range of speeds, the engine means being of such size and weight as to be carried in the hand of a user;

housing means for the engine means including handle means for carrying and manipulating the portable pressure washer during operative functions, the handle means being disposed on the top of said housing means;

manually operable engine control means associated with said handle means for controlling the speed of said engine means;

rotatable clutch means comprising drive and driven portions, the drive portion being operably connected to the output shaft of the engine means, the rotatable clutch means further comprising means for causing clutchable engagement between the drive and driven portions at a predetermined rotational speed;

positive displacement rotatable pump means operably connected to the driven portion of the rotatable clutch means and having an inlet adapted for connection to a source of liquid and an outlet, the rotatable pump means comprising pump housing means defining a cylindrical pump chamber with an inner cylindrical surface, a rotatable shaft operably connected to the driven portion of the rotatable clutch means, a rotor rotatably mounted on the rotatable shaft and disposed within said cylindrical pump chamber, and a plurality of vanes carried by the rotor in sliding engagement with the inner cylindrical surface of the pump chamber; and spray wand means comprising a substantial rigid outlet tube having first and second ends, the first end being substantially rigidly connected to the outlet of the pump means, and spray head means connected to the second end of the outlet tube;

the entirety of said portable pressure washer being carried by, maneuvered and operated with said handle means and the associated engine control means over a range of engine speeds to operate said pressure washer and controllably direct the spray emanating from spray head means.

2. The portable pressure washer defined by claim 1, wherein the engine means comprises a two-cycle internal combustion engine.

3. The portable pressure washer defined by claim 1, wherein the housing means comprises a downwardly projecting support leg.

4. The portable pressure washer defined by claim 1, wherein the handle means is mounted to said housing means through vibration absorbing means.

5. The portable pressure washer defined by claim 1, which further comprises second handle means connected to said rigid outlet tube.

6. The portable pressure washer defined by claim 5, wherein the second handle means is mounted to the outlet tube through vibration absorbing means.

7. The portable pressure washer defined by claim 1, wherein the means for causing clutchable engagement comprises a plurality of centrifugally movable weights mounted on said drive portion and clutchably engageable with said driven portion at said predetermined rotational speed.

8. The portable pressure washer defined by claim 1, wherein the engine means compromises an internal combustion engine having a predetermined idling speed, and the predetermined rotational speed of said rotatable clutch means is greater than said idling speed.

9. The portable pressure washer defined by claim 1, wherein each of said vanes is formed from carbon graphite.

10. The portable pressure washer defined by claim 1, which further comprises a fitting mounted to the inlet of the rotatable pump means which is adapted for connection to a garden hose.

11. The portable pressure washer defined by claim 1, wherein said manually operable control means comprises a trigger mounted on said handle means.

* * * * *